United States Patent [19]

Diamonstein

[11] Patent Number: 4,535,494

[45] Date of Patent: Aug. 20, 1985

[54] SLAT TYPE MATTRESS FOUNDATION

[75] Inventor: Arthur Diamonstein, Norfolk, Va.

[73] Assignee: Paramount Industrial Companies, Inc., Norfolk, Va.

[21] Appl. No.: 568,612

[22] Filed: Jan. 6, 1984

[51] Int. Cl.[3] ..... A47C 23/06

[52] U.S. Cl. ..... 5/400; 5/236 R; 5/200 R; 5/207

[58] Field of Search ..... 5/191, 200 R, 200 B, 5/203, 207, 236, 237, 238, 264 R, 131, 400, 401, 305

[56] References Cited

U.S. PATENT DOCUMENTS

| | | | |
|---|---|---|---|
| 2,097,976 | 11/1937 | Haberstump | 5/264 R |
| 3,605,141 | 9/1971 | Silverman | 5/236 |
| 3,813,713 | 6/1973 | Kipfer | 5/238 |
| 3,842,451 | 10/1974 | McCormick | 5/200 C |
| 3,940,810 | 3/1976 | Krakauer et al. | 5/200 R |
| 3,967,331 | 7/1976 | Glassman | 5/236 R |
| 4,074,372 | 2/1978 | Schulz, Jr. | 5/200 R |

FOREIGN PATENT DOCUMENTS

| | | | |
|---|---|---|---|
| 1009112 | 11/1965 | United Kingdom | 5/401 |

*Primary Examiner*—Gary L. Smith
*Assistant Examiner*—Michael F. Trettel
*Attorney, Agent, or Firm*—Bacon & Thomas

[57] ABSTRACT

A mattress foundation comprised substantially entirely of wood and having a rectangular configuration defined by a pair of longitudinal side assemblies, a pair of transverse end assemblies and a longitudinal center board, wherein the support surface of the foundation is formed from a plurality of spaced transverse slats, some of which being wider at the center one-third portion of the foundation for enhanced strength. A plurality of braces extend inwardly from corner portions of the foundation to the center board to provide additional support strength.

7 Claims, 5 Drawing Figures

SLAT TYPE MATTRESS FOUNDATION

BACKGROUND OF THE INVENTION

1. Field of the Invention

The present invention generally involves the field of technology pertaining to beds and related articles. More specifically, the invention relates to an improved foundation for supporting a mattress.

2. Description of the Prior Art

A conventional bed structure is known to include a foundation of some form, typically a box spring, for supporting a mattress thereon. It is also known to provide a framework of wood or other such rigid material to form a platform for supporting a mattress, thereby eliminating the need for a box spring. Mattress foundations of the latter type generally provide a very firm support surface which has been deemed advantageous and beneficial for sleeping.

However, conventional mattress foundations formed of rigid material have been characterized by certain disadvantages. For example, it is very common to make rigid mattress foundations from cardboard or similar materials, thus providing a product having a limited useful life. Conventional designs of this type are also lacking in sufficient support strength, particularly along the longitudinal central one-third portion of the foundation, thereby presenting an inherent potential for structural failure under heavy loading.

SUMMARY OF THE INVENTION

It is an object of the present invention to provide an improved mattress foundation having a high degree of support strength.

It is another object of the invention to provide a mattress foundation constructed substantially entirely of wood for easy construction and longevity in use.

It is a further object of the invention to provide a mattress foundation having an improved structural configuration for enhanced support strength along particularly the longitudinal central one-third portion of the foundation.

These and other objects of the invention are realized by providing an improved mattress foundation that is preferably constructed substantially entirely of wood and having a rectangular configuration defined by a pair of opposed longitudinal side assemblies, a pair of opposed transverse end assemblies and a longitudinal center board secured at its opposite ends to the end assemblies. The support surface of the foundation is formed from a plurality of spaced primary and secondary slats disposed transversely of the frame, with the secondary slats being wider than the primary slats and disposed along the longitudinal central one-third portion of the foundation for enhanced support strength. A pair of braces preferably extends from corresponding corners of each end assembly and converge inwardly toward and are secured to opposite sides of the center board at points disposed substantially on opposite sides of the longitudinal central one-third portion of the foundation. Each side assembly is defined by spaced upper and lower side rails and each end assembly is defined by spaced upper and lower end rails. The side assemblies and end assemblies are connected to four corner blocks and a pair of opposed center blocks are secured to the internal walls of the side assemblies for supporting a secondary slat. Longitudinal stiffeners are carried by the side assemblies for supporting the remaining secondary slats and substantially all the primary slats.

Other objects, features and advantages of the invention shall become apparent from the following description of a preferred embodiment thereof, with reference to the accompanying drawings which form a part of the specification, wherein like reference characters designate corresponding parts of the several views.

DETAILED DESCRIPTION OF THE PREFERRED EMBODIMENTS

Figure 1:
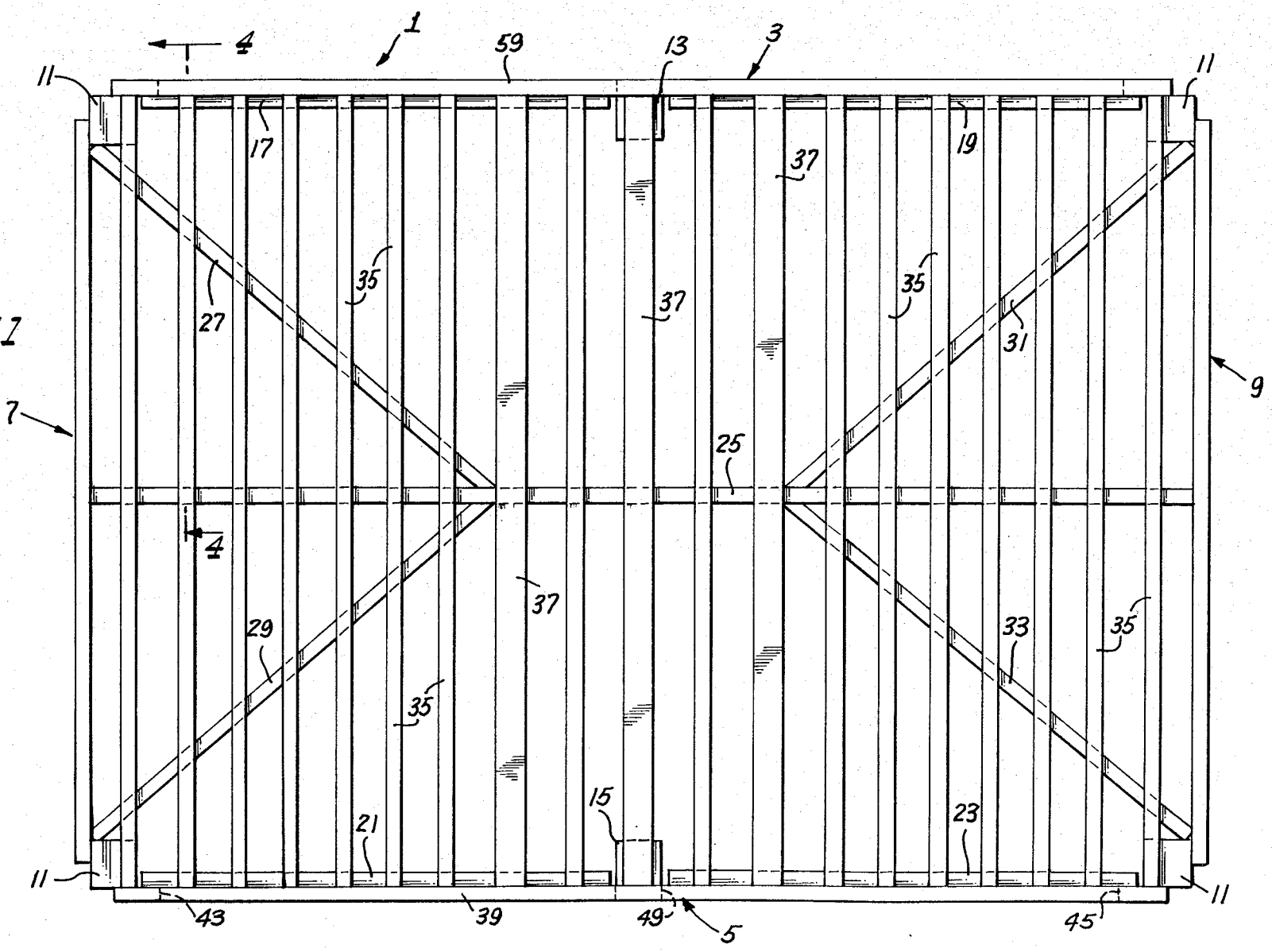
FIG. 1 is a plan view of a mattress foundation according to a preferred embodiment of the present invention.

A mattress foundation 1, according to a preferred embodiment of the invention, shall now be described with initial reference to FIG. 1. As shown therein, foundation 1 is a rectangular-shaped frame that is generally defined by a pair of opposed longitudinal side assemblies 3,5 and a pair of opposed transverse end assemblies 7,9. The corresponding adjacent ends of each side assembly 3,5 and each end assembly 7,9 are secured together by a corner block 11.

Side assembly 3 is also provided with a center block 15 secured to its inwardly facing midpoint. Likewise, side assembly 5 is provided with a center block 15 secured to its inwardly directed midpoint. Side assembly 3 is further provided with a pair of longitudinal stiffeners 17 and 19 disposed on opposite sides of center block 13 and extending for substantially the entire length of side assembly 3. Likewise, side assembly 5 is provided with a pair of longitudinal stiffeners 21 and 23 on opposite sides of center block 15 and extending along substantially the entire length of side assembly 5.

The rectangular-shaped frame configuration of foundation 1 is further defined by a center board 25 which extends longitudinally of foundation 1 and has its opposite ends secured to the inwardly directed midpoints of opposed end assemblies 7 and 9. A pair of braces 27 and 29 converge inwardly from corresponding corner blocks 11 of end assembly 9 and are secured to opposite sides of center board 25. Likewise, a pair of braces 31 and 33 converge inwardly from corresponding corner blocks 11 of end assembly 9 and are secured to opposite sides of center board 25. It is important to note that the attachment points of braces 27,29 and 31,33 to center board 25 are disposed substantially on opposite sides of the longitudinal central one-third portion of foundation 1 for imparting enhanced support strength thereto at this critical area.

The upper support surface of foundation 1 is substantially entirely defined by a plurality of primary slats 35 and a lesser number of secondary slats 27. Slats 35 and 37 are disposed transversely and spaced from each other longitudinally across foundation 1. The upper surfaces of slats 35 and 37 are substantially smooth and coplanar with each other, and also coplanar with the upper surfaces of side assemblies 3,5 and end assemblies 7,9 for supporting a foam rubber pad (not shown) and/or mattress (not shown). It is important to note that slats 35 are each of substantially the same width and slats 37 are each of substantially the same width, with the width of each slat 35 being significantly narrower than the width of each slat 37. Slats 37 are preferably disposed in alternating fashion with slats 35 along substantially the longitudinal central one-third portion of foundation 1 for the purpose of providing enhanced strength and support along this critical area. It should further be noted that a slat 37 is disposed across the longitudinal central point of foundation 1 and has its opposite ends supported by opposed center blocks 13 and 15. The opposite ends of remaining slats 35 and 37 are supported on stiffeners 17 and 19 carried by side assembly 3 and stiffeners 21 and 23 carried by side assembly 5. The extreme end slats 35 are preferably supported by corresponding corner blocks 11 of end assemblies 7 and 9. It is further preferred that slats 35 and 37 be evenly spaced along the length of foundation 1, with the number of such slats being variable as required to provide the necessary support strength desired for foundation 1.

Figure 2:
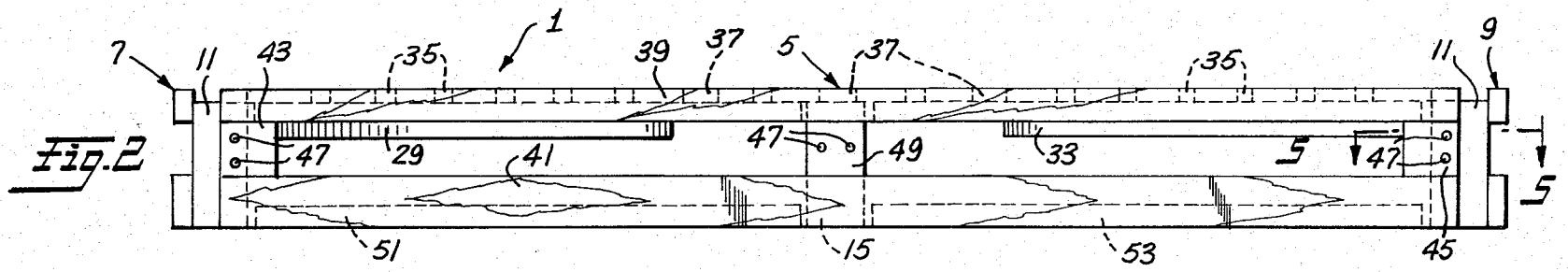
FIG. 2 is a side elevational view of the foundation of FIG. 1.

The details of side assemblies 3 and 5 shall now be described with reference to FIG. 2. Since the structural details of assemblies 3 and 5 are identical, FIG. 2 shall be described only with respect to side assembly 5. As shown, side assembly 5 is comprised of an upper side rail 39 and a lower side rail 41 which are secured in a spaced relationship from each other to their corresponding corner blocks 11 and center block 15. It is preferred that spacer plates 43 and 45 be secured to corresponding corner blocks 11 of side assembly 5 by a plurality of mechanical fasteners 47, such as screws, bolts or the like. Similarly, center block 15 is also provided with a spacer plate 49 secured thereto by fasteners 47. Spacer plates 43, 45 and 49 serve the dual purpose of providing a smooth exterior finish to side assembly 5 and enhanced support for upper side rail 39. As also shown in FIG. 2, lower side rail 41 is provided with a pair of corresponding stiffeners 51 and 53 disposed on opposite sides of center block 15 and extending longitudinally for substantially the entire length of side assembly 5. It is to be again understood that the structural details just described for side assembly 5 are virtually the same as those for its opposed side rail 7.

Figure 3:
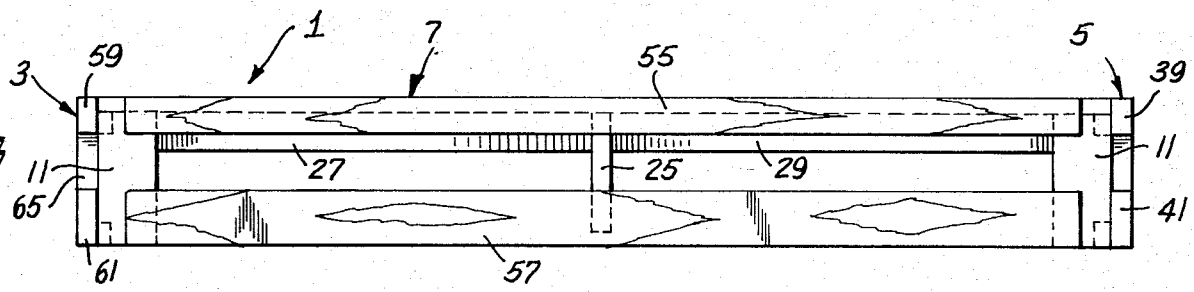
FIG. 3 is an end elevational view of the foundation of FIG. 1.
Figure 4:
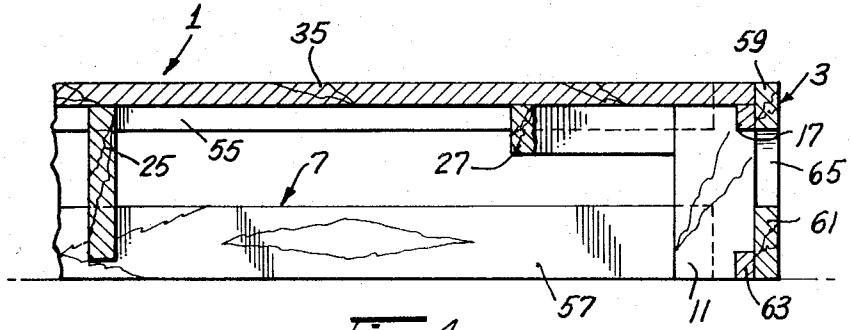
FIG. 4 is an enlarged fragmentary vertical sectional view, taken on the line 4—4 of FIG. 1.

The details of end assemblies 7 and 9 shall be described with reference to FIG. 3. Since the structural configuration of end assemblies 7 and 9 are identical, FIG. 3 shall be described only with respect to end assembly 7. As shown therein, assembly 7 is comprised of an upper end rail 55 and a lower end rail 57, with rails 55 and 57 being spaced from each other and secured to their corresponding corner blocks 11 and one end of center board 25. No spacer plates are shown between end rails 55 and 57, but it is to be understood that such plates may be utilized if deemed desirable for appearance and strength purposes. Again, the configuration just described for end assembly 7 also applies for its opposed counterpart, end assembly 9. With reference now to FIG. 4, there is shown a cross section of foundation 1 depicting side assembly 3 and end assembly 7. Side assembly 3 includes an upper side rail 59 to which stiffener 17 is attached. A lower side rail 61 is spaced from upper side rail 59 and is provided with a stiffener 63. Side rails 59 and 61 are secured to their corresponding corner block 11 and provided with a spacer plate 65 therebetween. As is further shown by FIG. 4, the upper surface of brace 27 and its corresponding brace 29 (not shown) are coplanar with the upper surfaces of center board 25 and corner block 11 to define a level support for slats 35 and 37. The configuration just described for FIG. 4 also applies for the remaining three corner portions of foundation 1.

Figure 5:
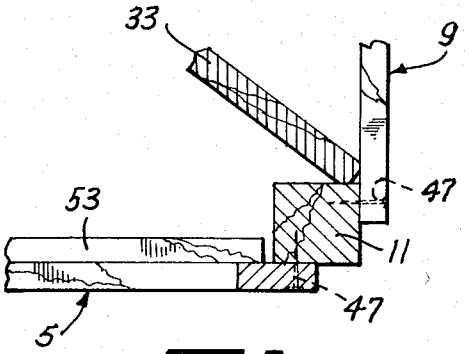
FIG. 5 is an enlarged fragmentary horizontal sectional view taken on the line 5—5 of FIG. 2.

As shown in FIG. 5, side assembly 5 and end assembly 9 have their ends secured inwardly of the outermost edge of their corresponding corner block 11 by a plurality of mechanical fasteners 67, such as screws, bolts or the like. The end of brace 37 is preferably secured to the intersection of end assembly 9 and block 11. This configuration is the same for the remaining three corner portions of foundation 1 and their corresponding braces 27, 29 and 31.

It is preferred that all of the aforedescribed components defining the structure of foundation 1 be entirely of wood. However, it is possible that some of the components may be formed of other similar rigid materials which might be deemed suitable for the purpose and practice of the invention as described herein.

The assembly of the components making up foundation 1 may be accomplished through any techniques well known in the art for the type of materials utilized. It is preferred that the components are partially or entirely glued together and also secured partially or entirely through the use of mechanical fasteners, such as nails, screws, bolts or the like. The exterior finishes and spacings of the exposed components may be varied for optimum aesthetic appeal and commercial acceptance.

By way of example, the cross-sectional dimensions of some of the components making up foundation 1 may be as follows: 3 inch×3 inch corner blocks; 1 inch×2 inch upper side rails; 1 inch×3 inch lower side rails; 1 inch×3 inch spacer plates; 1 inch×1⅛ inch stiffeners; 1 inch×2 inch braces; 1 inch×1⅛ inch primary slats; 1 inch×2 inch secondary slats; and 1 inch×6 inch center board. The lengths of these components may of course be varied as required in order to construct foundation 1 of the desired size.

In utilizing foundation 1, it is preferred that a layer of foam rubber having a desired thickness and density be disposed on the upper surface of foundation 1. A mattress is thereafter disposed on the foam layer, with the latter assisting in controlling the degree of firmness experienced by the user. For a very firm support, it may be desirable to dispense with the foam layer and place a mattress directly on foundation 1.

While the invention has been described and illustrated with reference to certain preferred embodiments and operating parameters, it shall be appreciated that various modifications, changes, additions, omissions and substitutions in sizes and shapes may be resorted to by those skilled in the art and considered to be within the spirit and scope of the invention and the appended claims.

I claim:

1. A mattress foundation comprising:

(a) A rectangular frame defined by a pair of longitudinal side assemblies, a pair of transverse end assemblies, and a longitudinal center board having its opposite ends secured to the end assemblies;

(b) a support surface defined substantially by a plurality of primary and secondary slats extending transverely across the frame and spaced longitudinally therealong;

(c) each primary slat being of a first width and each secondary slat being of a second width, with the first width being narrower than the second width;

(d) the secondary slats being confined to substantially the longitudinal one-third portion of the frame; and (e) a pair of braces extending from the corresponding corners of each end assembly and converging to the center board at two points substantially adjacent the opposite sides of the longitudinal central one-third portion of the frame.

2. The foundation of claim 1 further including four corner blocks and wherein:

(a) each side assembly is defined by an upper side rail and a lower side rail spaced therefrom;

(b) each end assembly is defined by an upper end rail and a lower end rail spaced therefrom; and (c) the adjacent ends of each side rail and each end rail are secured to a corner block.

3. The foundation of claim 2 further including:

(a) a center block secured to the internal midpoint of each side assembly; and (b) a pair of longitudinal stiffeners secured to each side rail on opposite sides of the center block and extending for substantially the entire length of the side assembly.

4. The foundation of claim 3 wherein:

(a) the opposite ends of substantially all primary and secondary slats are supported on the stiffeners of the upper side rails; and (b) the opposite ends of one secondary slat are supported on the center blocks.

5. The foundation of claim 4 wherein the primary slats directly adjacent the end assemblies are each secured to its corresponding corner blocks.

6. The foundation of claim 3 further including three spacer plates disposed between the upper and lower side rails of each side assembly and secured to the two corner blocks and center block.

7. The foundation of claim 1 wherein the foundation is substantially entirely of wood.

* * * * *